United States Patent [19]

Anderson

[11] 4,014,804

[45] Mar. 29, 1977

[54] CORROSION REMOVAL COMPOSITION

[75] Inventor: Gordon B. Anderson, Dickinson, Tex.

[73] Assignee: Gultex, Incorporated, Dickinson, Tex.

[22] Filed: Apr. 4, 1975

[21] Appl. No.: 565,146

[52] U.S. Cl. ..... 252/85; 134/3; 148/6.16; 252/87; 252/136; 252/147

[51] Int. Cl.[2] ..... C02B 5/02; C11D 7/08; C23G 1/04; C23G 1/08

[58] Field of Search ..... 134/3; 252/85, 87, 136, 252/147; 148/6.16, 6.17, 6.21

[56] References Cited

UNITED STATES PATENTS

| | | | |
|---|---|---|---|
| 1,317,351 | 9/1919 | Chadwick | 148/6.17 |
| 2,049,517 | 8/1936 | Saukaitis | 252/147 X |
| 2,678,291 | 5/1954 | Spruance | 148/6.17 X |
| 3,074,824 | 1/1963 | Binger | 252/136 X |

OTHER PUBLICATIONS

H. Bennett: The Chemical Formulary, vol. IV, Chemical Publishing Co., New York, 1939, p. 286.
H. Bennett: The Chemical Formulary, vol. VI, Chemical Publishing Co., New York, 1943, p. 238.
H. Bennett: The Chemical Formulary, vol. VIII, Chemical Publishing Co., New York, 1948, p. 247.
H. Bennett: The Chemical Formulary, vol. X, Chemical Publishing Co., New York, 1957, pp. 228–230.

*Primary Examiner*—Dennis L. Albrecht

[57] ABSTRACT

A composition comprising 2 to 10% by weight of a sulfate of copper, 0.05 to 1.0% by weight of an alkali metal bichromate, 0.05 to 1.0% by weight of a surfactant, 15 to 35% by weight of phosphoric acid (based on contained phosphoric acid) and 50 to 85% by weight of water, the total of all components equaling 100% and a method for preparing and using said composition.

12 Claims, No Drawings

CORROSION REMOVAL COMPOSITION

BACKGROUND OF THE INVENTION

The present invention relates to the removal of corrosion from metal surfaces. More particularly, the present invention relates to a composition and method for its preparation and use, useful in the removal of corrosion, i.e., rust, from metal surfaces.

Removal of corrosion from metal surfaces has been a problem since there has been metal. Particularly, the removal of rust from iron containing metals has been a problem. Many compounds and compositions have been proposed and tried in the past for rust removal. Many of these have been found to act too slowly or to require significant physical aid to their action in the removal of rust. Others have been found to remove rust effectively but to be damaging themselves to metal surfaces. In addition, many of the compounds and compositions previously known are far too dangerous to those using such materials to be acceptable for use by the general public. Further, many of such compounds and compositions, while effective and not extremely dangerous, are very expensive and not economically feasible for use by the general public. Therefore, there is a need for new corrosion removing compositions which are effective, not as dangerous as many of those previously known, and commercially feasible for use by the general public.

It is an object of the present invention to provide a new and improved composition for the removal of corrosion from metal surfaces.

Another object of the present invention is to provide a new and improved composition for the removal of rust which is highly effective when compared with conventionally used rust removal compositions.

Still another object of the present invention is to provide a new and improved composition for the effective removal of corrosion which does not damage the metal surfaces containing such corrosion.

A remaining object of the present invention is to provide a new and improved composition for the removal of rust from metal surfaces which is less dangerous in use and less expensive than many conventional rust removing compositions and compounds of similar effectiveness.

Additional objects will become apparent from the following description of the invention herein disclosed.

SUMMARY OF THE INVENTION

The present invention, which fulfills these and other embodiments, is a composition comprising 2 to 10% by weight of a sulfate of copper, 0.05 to 1.0% by weight of an alkali metal bichromate, 0.05 to 1.0% by weight of a surfactant, 15 to 35% by weight of phosphoric acid (based on contained phosphoric acid) and 50 to 85% by weight of water, the total of all components equaling 100%.

In another embodiment, the present invention is a method for preparing a corrosion removing composition, said method comprising heating water to a temperature of 140° to 160° F, dissolving therein while agitating, a sulfate of copper and an alkali metal bichromate, adding a surfactant, allowing to cool and dispersing therein phosphoric acid, the respective amounts of each of the ingredients added being sufficient to produce a compositon containing 2 to 10% by weight of a sulfate of copper, 0.05 to 1.0% by weight of an alkali metal bichromate, 0.05 to 1.0% by weight of a surfactant, 15 to 35% by weight of phosphoric acid and 50 to 85% by weight of water, the total of all components being 100%.

In still another embodiment, the present invention is a process for removing corrosion from metal surfaces, the process comprising applying the hereinabove defined corrosion removing composition to the metal surface containing said corrosion in quantity sufficient to cover the area of said corrosion, permitting said composition to remain on said metal surface for a period in excess of five minutes.

Through the use of the present invention, metal surfaces may be effectively cleared of corrosion.

DESCRIPTION OF THE PREFERRED EMBODIMENTS

The sulfate of copper most often used in the compositions of the present invention is the cupric sulfate. The amount of the sulfate of copper employed generally is within the range of 2 to 10% by weight of the total composition. Preferably, however, the amount of sulfate of copper employed and the present composition is 4 to 8% by weight.

While almost any of the alkali metal bichromates may be employed in the composition and process of the present invention, those most often used are the sodium or potassium bichromate. As used herein, the term "bichromate" is intended to include the dichromate as well as the bichromate. Because of availability and cost, the sodium bichromate is the preferred of the alkali metal bichromates, although from the standpoint of effectiveness the potassium dichromate is equally well preferred. The amount of the alkali metal bichromate employed generally will range from 0.05 to 1.0% by weight of the composition. Preferably, however, the amount of alkali metal bichromate used will be within the range of 0.1 to 0.5% by weight of the composition.

The surfactant used in the compositions of the present invention may include any of the well known nonionic, cationic and anionic surfactants. Included within this group are such materials as the alkyl phenyl ethers of polyethylene glycol, dodecyl phenol adducts with varying mols of ethylene oxide, the trimethylalkyl ethers of polyethylene glycol, polyalkylene glycol ethers, alkyl mercaptan adducts with ethylene glycol, secondary alcohols and their ammonium sulfate salts with ethylene oxide, alkyl aryl plyether alcohols, and the like. Particularly useful are the surfactants manufactured and sold by Union Carbide Corporation under the trade name "Tergitol". The surfactant generally is employed in an amount of 0.01 to 1.0% by weight of the composition. More often, however, it is used in an amount of 0.05 to 0.05% by weight, preferably 0.05 to 0.3% by weight, of the total composition.

A primary ingredient of the composition of the present invention is phosphoric acid, $H_3PO_4$. The concentration of the phosphoric acid employed may vary, but for practical considerations an 85% concentration acid is most often employed. The amount of phosphoric acid generally used is within the range of 15 to 35% by weight of the total composition based on $H_3PO_4$in the particular grade of phosphoric acid used. Preferably, the amount of $H_3PO_4$ is within the range of 20 to 30% by weight of the total composition.

The remainder of the composition of the present invention is water which generally is present in an amount of 50 to 85% by weight of the total composition. Preferably, however, the amount of water present is within the range of 65 to 75% of the total composition. The amount of water present within the above ranges include any water present in the particular phosphoric acid composition employed.

In preparing the compositions of the present invention, it is desirable that certain specific steps be followed. The steps comprise first dissolving the alkali metal bichromate and sulfate of copper in water at a temperature of 170°–160° F with agitation. The amount of water initially employed is that just sufficient to permit the alkali metal bichromate and sulfate of copper to be dissolved. The remaining water is then added later as hereinbelow discussed. Of course, the entire amount of water to be in the final composition may be utilized in the first step, but for practical considerations, the amount initially employed more often is within the above range. This avoids unnecessary heating and handling expenses and problems.

After the alkali metal bichromate and the sulfate of sulfur are substantially dissolved in the water, the surfactant is added with agitation. Additional water is then added to bring the total volume of the mixture to approximately 5 to 8% of the final volume of the composition.

After cooling, a phosphoric acid solution is next added in an amount to provide the hereinabove weight percent of the final composition of $H_3PO_4$. The phosphoric acid is intimately dispersed within the mixture. Sufficient water is then added to bring the total water present in the final composition to within the hereinabove weight range and to bring the total percentage of all components to 100%. The composition is then ready to use.

The method of removing rust in accordance with the present invention comprises as a first step the application of the hereinabove defined corrosion removing composition to the rust coated metal surface. For optimum results, the rust coated surfaces are first freed of dirt, grease or oil. After application of the corrosion removing composition, the composition is allowed to remain in contact with the metal surface for a period of 5 to 20 minutes, preferably 10 to 15 minutes or until dryness occurs, whichever first occurs. The treated area of the metal surface is then wiped clean. For severe rusting, two or more applications of the hereinabove defined corrosion removing composition may be required.

What is claim is:

1. A method for preparing a corrosion removing composition, said method comprising heating water to a temperature of 140° to 160° F, dissolving therein while agitating, a sulfate of copper and an alkali metal bichromate, adding a surfactant, allowing to cool and dispersing therein phosphoric acid, the respective amounts of each of the ingredients added being sufficient to produce a composition containing 2 to 10% by weight of a sulfate of copper, 0.05 to 1.0% by weight of an alkali metal bichromate, 0.05 to 1.0% by weight of a surfactant, 15 to 35% by weight of phosphoric acid and 50 to 85% by weight of water, the total of all components being 100%.

2. The method of claim 1 wherein the alkali metal bichromate is sodium bichromate.

3. The method of claim 1 wherein the alkali metal bichromate is potassium dichromate.

4. The method of claim 1 wherein the amount of alkali metal bichromate is 0.1 to 0.5% by weight of the composition.

5. The method of claim 1 wherein said surfactant is one selected from the group consisting of the alkyl, phenyl ethers of polyethylene glycol, dodecyl phenol adducts with ethylene oxide, trimethylalkyl ethers of polyethylene glycol, polyalkylene glycol ethers, alkyl mercaptain adducts with ethylene glycol, secondary alcohols and their ammonium sulfate salts with ethylene oxide, alkyl aryl polyether alcohols and mixtures thereof.

6. The method of claim 1 wherein the amount of said surfactant is 0.05 to 0.5% by weight of said composition.

7. The method of claim 1 wherein the amount of said surfactant is 0.05 to 0.3% by weight of said composition.

8. The method of claim 1 wherein the amount of phosphoric acid is 20 to 30% by weight of said composition.

9. The method of claim 1 wherein the amount of water is 65 to 75% by weight of said composition.

10. The method of claim 1 wherein said sulfate of copper is cupric sulfate.

11. The method of claim 1 wherein the amount of said sulfate of copper is 4 to 8% by weight of said composition.

12. The method of claim 1 wherein the phosphoric acid solution employed is an 85% solution.

* * * * *